US010090576B2

(12) United States Patent
Bombelli

(10) Patent No.: US 10,090,576 B2
(45) Date of Patent: Oct. 2, 2018

(54) SWITCHLESS COMBINER FOR ADDRESSING OF RADIOFREQUENCY SIGNALS AND SYSTEM FOR TRANSMISSION OF RADIOFREQUENCY SIGNALS COMPRISING SAID COMBINER

(71) Applicant: ONETASTIC S.R.L., Brescia (BS) (IT)

(72) Inventor: Carlo Bombelli, Roncadelle (IT)

(73) Assignee: Onetastic S.R.L., Brescia (BS) (IT)

( * ) Notice: Subject to any disclaimer, the term of this patent is extended or adjusted under 35 U.S.C. 154(b) by 10 days.

(21) Appl. No.: 14/786,640

(22) PCT Filed: Apr. 17, 2014

(86) PCT No.: PCT/IB2014/060799
§ 371 (c)(1),
(2) Date: Oct. 23, 2015

(87) PCT Pub. No.: WO2014/174413
PCT Pub. Date: Oct. 30, 2014

(65) Prior Publication Data

US 2016/0064797 A1 Mar. 3, 2016

(30) Foreign Application Priority Data

Apr. 24, 2013 (IT) ..... TO2013A0337

(51) Int. Cl.
*H01P 5/12* (2006.01)
*H01P 1/18* (2006.01)
(Continued)

(52) U.S. Cl.
CPC ..... *H01P 5/12* (2013.01); *H01P 1/184* (2013.01); *H01P 3/02* (2013.01); *H01P 9/003* (2013.01); *H01P 1/127* (2013.01)

(58) Field of Classification Search
CPC .... H01P 5/12; H01P 1/184; H01P 3/02; H01P 9/003; H01P 1/127
(Continued)

(56) References Cited

U.S. PATENT DOCUMENTS 3,005,168 A 10/1961 Fye
3,316,509 A * 4/1967 Ayer ..... H01P 1/183 333/156
(Continued)

FOREIGN PATENT DOCUMENTS

DE 25 35 257 A1 3/1976
WO 2013/084195 A1 6/2013

OTHER PUBLICATIONS

International Search Report dated Aug. 4, 2014, issued in PCT Application No. PCT/IB2014/060799, filed Apr. 17, 2014.
(Continued)

*Primary Examiner* — Robert J Pascal
*Assistant Examiner* — Kimberly Glenn
(74) *Attorney, Agent, or Firm* — Workman Nydegger

(57) ABSTRACT

A switchless combiner includes a circuit having a delay line consisting of a constant-impedance transmission line and a device adapted to vary the electric length of said transmission line, the device including a metallic body with walls defining a cavity, the walls being interrupted to define a slot, the cavity and the slot extending along at least a portion of the length of the device, the cavity including a first portion having a first cross-section and a second portion having a second cross-section which is greater than the first cross-section, the second portion having a dielectric element with a cutout corresponding to the slot, the first and second portions extending in the longitudinal direction of the device and the transmission line being positioned, inside the first and second portion, in the cutout, the dielectric element
(Continued)

occupying the cavity of the second portion, and having an element to translate the dielectric element on the circuit in the longitudinal direction of the device.

12 Claims, 3 Drawing Sheets

(51) Int. Cl.
*H01P 9/00* (2006.01)
*H01P 3/02* (2006.01)
*H01P 1/12* (2006.01)

(58) Field of Classification Search
USPC ..... 333/125
See application file for complete search history.

(56) References Cited

U.S. PATENT DOCUMENTS

| | | | |
|---|---|---|---|
| 3,440,573 | A | 4/1969 | Butler |
| 3,967,220 | A | 6/1976 | Tagashira et al. |
| 6,882,244 | B2 | 4/2005 | Stenberg |
| 2011/0193624 | A1 | 8/2011 | Scott et al. |

OTHER PUBLICATIONS

International Preliminary Report on Patentability dated Oct. 27, 2015, issued in PCT Application No. PCT/IB2014/060799, filed Apr. 17, 2014.

* cited by examiner

SWITCHLESS COMBINER FOR ADDRESSING OF RADIOFREQUENCY SIGNALS AND SYSTEM FOR TRANSMISSION OF RADIOFREQUENCY SIGNALS COMPRISING SAID COMBINER

BACKGROUND OF THE INVENTION

1. Field of the Invention

The present invention relates, in general, to a switchless combiner for routing radio-frequency signals, in particular radio-frequency signals being transmitted by a broadcaster.

The invention also relates to an apparatus for transmitting radio-frequency signals comprising said switchless combiner, for use in radio-television broadcasting.

2. Present State of the Art

With reference to FIG. 1, there is shown a general diagram of a known transmission system 5 comprising a switchless combiner 1 of radio-frequency signals, in particular television broadcast signals, a first transmitter 2 and a second transmitter 3 irradiating one same service for redundancy or power enhancement purposes.

The first and second transmitters 2,3 are coupled to the switchless combiner 1, which comprises a first input 6, a second input 7, a first output 8 and a second output 9. The first and second transmitters 2,3 are respectively connected to the first and second inputs 6,7 via respective transmission lines 12,12'. A transmission antenna 15 is connected to the first output 8 of the switchless combiner 1, whereas to the second output 9 a so-called passive load 17, or "dummy load", is connected, which alternatively allows routing to the transmission antenna 15:

- the power of the first transmitter 2 only, the power of the second transmitter 3 being routed to the passive load 17;
- the power of the second transmitter 3 only, the power of the first transmitter 2 being routed to the passive load 17;
- the sum of the powers of the first and second transmitters 2,3, nothing being routed to the passive load 17;
- nothing, the sum of the powers of the first and second transmitters 2,3 being routed to the passive load 17.

It must be pointed out that the element designated by reference numeral 15 and the element designated by reference numeral 17 must not necessarily be a transmission antenna and a dummy load, respectively, since they may, for example, be two transmission antennae or two dummy loads or other transmitters and the like.

The above configuration variations can also be attained while the transmitters 2,3 are operative, so as, for example, to place the first transmitter 2 into maintenance mode 2 without interrupting the service, which can still be provided to the public by the second transmitter 3 (at halved power, if coupled operation was used in normal conditions).

Switchless combiners are known in the art which utilize a system that is conceptually similar to a trombone coulisse: by varying the phase of the transmitters' signal along the branches of the switchless combiner, one modifies the combination effect obtained at the combiner's output; in other words, it is possible to vary the power percentage of each signal derived from the transmitters.

Systems are also known which utilize a dielectric in order to vary the phase of an electric signal in transit in a waveguide. In this regard, U.S. Pat. No. 6,882,244 discloses a system for switching signals in waveguides, which comprises a switchless combiner. A dielectric material is positioned into the cavity of the waveguide, and the signal phase will vary according to the dimensions of the inserted dielectric portion. In particular, the bigger the inserted dielectric portion, the greater the phase variation of the wave that represents the electric signal. The use of dielectric material is dictated also by the fact that this material does not irradiate heat in continuous operation.

However, said U.S. Pat. No. 6,882,244 shows no solution for signal phase variation in a system with metallic conductors, in particular coaxial ones; moreover, both the dielectric material in use and the dielectric constant need to be taken into account.

At present, a variable phase delay along the path of a signal is typically implemented in a number of different ways.

The simplest way of introducing a phase delay along the path of a signal is to have said signal transit along a constant-impedance line having such a length that said signal, travelling at a speed equal to the typical speed of the physical medium, takes a time equal to the desired delay to cover the conductive element involved.

An alternative way is to have said signal transit along a constant-impedance line whose electric length is varied by changing the material, and hence the dielectric constant thereof, used for making the line itself, since the wave propagation speed is related to the dielectric constant of the material that the dielectric substance is made of.

In order to avoid any signal alterations, the line must have a known constant impedance, compatible with the surrounding circuit elements.

The phase delay is typically made variable in two ways:

1) the physical length of the line is modified, thus also modifying the length of the conductive element because, all other conditions being equal, if the physical length of the conductive element is doubled, the delay being introduced will be doubled as well; or 2) the electric length of the line itself is modified.

The electric length is the length of a transmission medium, expressed as the number of wavelengths of the signal propagating in the transmission medium. The electric length is more commonly expressed in the wavelength unit λ, which is correlated to propagation speed v and frequency f by the following relation:

$$\lambda = v/f$$

In substance, the electric length indicates how much a transmission medium offsets/delays a signal at a certain frequency.

SUMMARY OF THE INVENTION

It is one object of the present invention to provide a switchless combiner comprising a device adapted to introduce a phase delay on the electric signals in transit therein, and a method thereof, which is of simple and economical construction.

It is another object of the invention to provide a switchless combiner comprising a device adapted to introduce a phase delay on the electric signals in transit therein, and a method thereof, wherein the phase of the signals, and hence the power thereof, can be adjusted without having to act upon at least one transmitter of said signals.

These and other objects of the invention are achieved through a switchless combiner comprising a device adapted to introduce a phase delay on the electric signals in transit therein, and a method thereof, as set out in the appended claims, which are an integral part of the present description.

In brief, the present invention allows varying the electric length of a delay line consisting of a constant-impedance transmission line of a switchless combiner, by modifying the resulting dielectric constant of the transmission line itself while keeping the impedance constant. In fact, the electric length introduced by a constant-impedance transmission line is affected by the length of the transmission line itself and also by the dielectric constant $\varepsilon_r$ of the material it is made of.

Given a constant-impedance transmission line having a fixed length L, the resulting dielectric constant of the line material can be varied by immersing at least a portion thereof into a dielectric medium having a second dielectric constant, which is greater than the dielectric constant of the air in which the remaining line portion is immersed.

Other dielectric constants may be used and taken into account, and air may be replaced, for example, with other materials having a different dielectric constant, without prejudice to the principle and scope of the invention. It is therefore sufficient to utilize two different materials having a different dielectric constant.

By modifying the length of the portion of conductive element immersed in the material characterized by the second dielectric constant, the electric length of the element itself is changed. In order to keep the line impedance constant, the conductive element is positioned into the cavity of a device having controlled dimensions, such as to retain a constant impedance.

The variation of the electric length implies, therefore, a variation of the phase delay of the signal in transit on the transmission line.

Further features of the invention are set out in the appended claims, which are intended to be an integral part of the present description.

BRIEF DESCRIPTION OF THE DRAWINGS

The above objects will become more apparent from the following detailed description of a switchless combiner comprising a device adapted to introduce a phase delay on the electric signals in transit therein, and a method thereof, with particular reference to the annexed drawings, wherein.

DETAILED DESCRIPTION OF THE PREFERRED EMBODIMENTS

Figure 1:
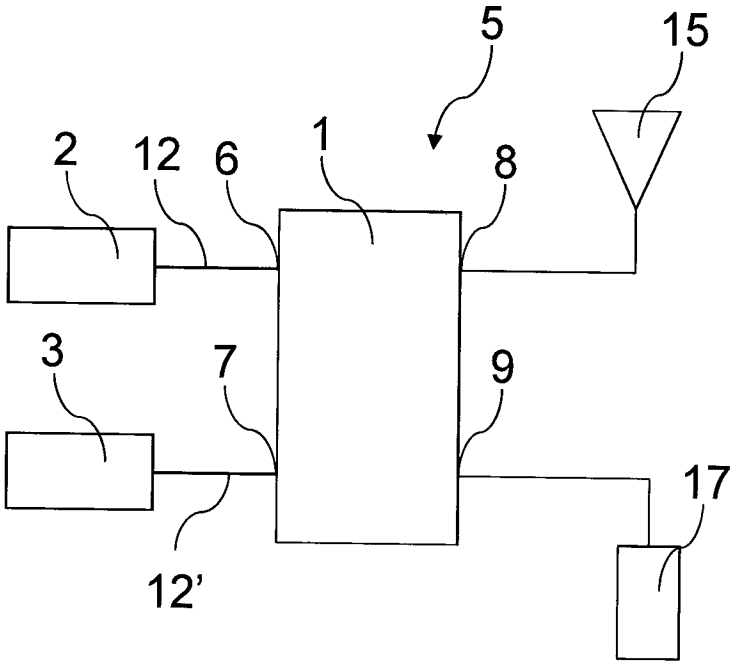
Fig. 1 (Prior Art)
FIG. 1 is a diagram of a prior-art transmission system.
Figure 2:
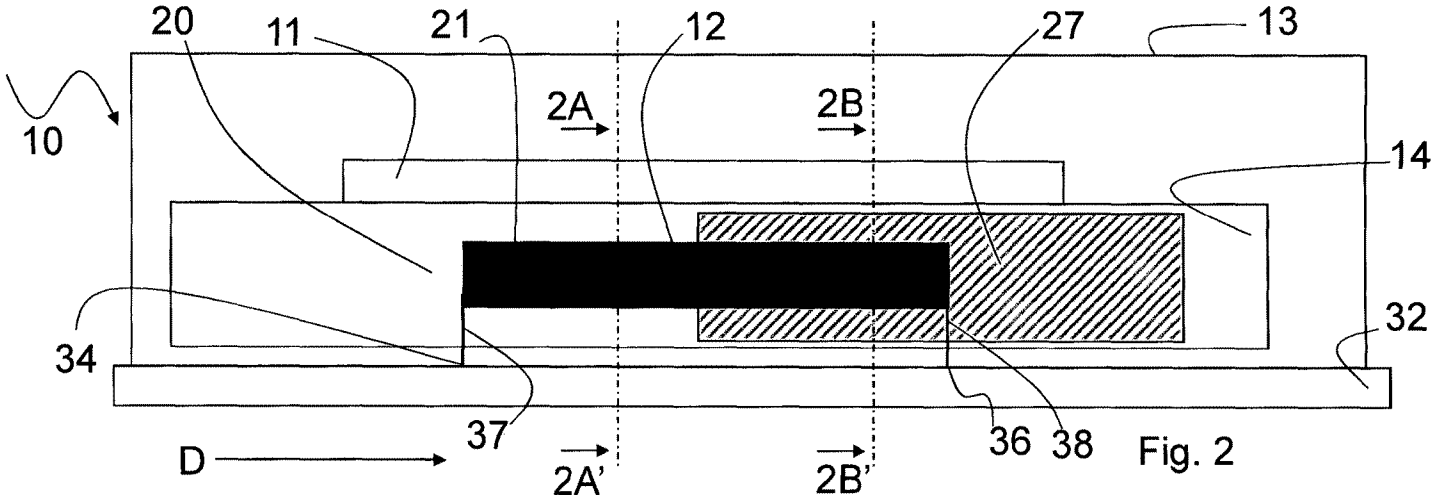
FIG. 2 is a longitudinal sectional view of a device for varying the electric length of a signal transmission line.
Figure 2B:
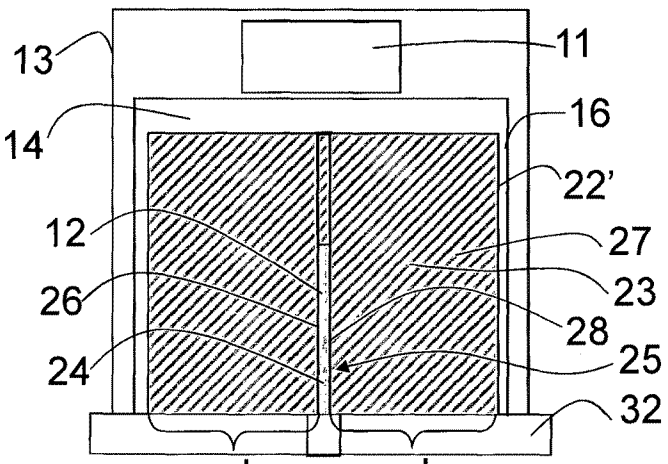
FIGS. 2*a* and 2*b* are sectional views along the lines 2A-2A' and 2B-2B', respectively, of FIG. 2.
Figure 2A:
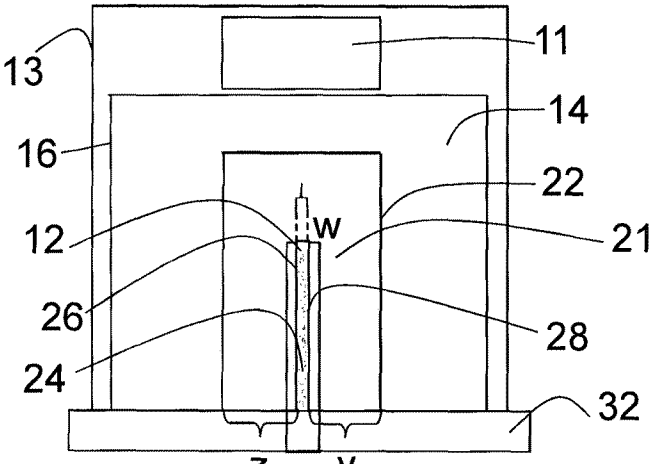

With reference to FIGS. 2, 2*a* and 2*b*, there is shown a device 10 for introducing a phase delay on a signal. Said phase delay is obtained by varying the electric length of a constant-impedance transmission line 12,12', in particular a transmission line having substantially constant thickness and width, adapted to transport an electric signal such as those inputted to a switchless combiner.

The device 10 comprises a metallic body 14, e.g., made of aluminium or steel, extending in a substantially longitudinal direction D.

The device 10 may comprise a casing 13, the function of which is to shield the device 10 from the environment outside the casing 13.

The metallic body 14 has an outer wall 16, preferably with a constant cross-section, and an inner wall 22,22' that defines a cavity 20.

The outer wall 16 and the inner wall 22,22' are interrupted in a manner such as to define a slot 24. The cavity 20 and the slot 24 extend along at least a portion of the length of the device 10.

The cavity 20 comprises a first portion 21 having a first cross-section and a second portion 23 having a second cross-section, which is greater than the first cross-section.

The second portion 23 of the cavity 20 comprises a dielectric element 27 with a cutout 25 which is positioned in correspondence of the slot 24 of the metallic body 14.

The dielectric element 27 occupies the second portion 23 of the cavity 20 and is made of a dielectric material, e.g., teflon, also called PTFE ("PolyTetraFluoroEthylene"), having a greater dielectric constant than air.

In a preferred embodiment of the invention, to which the following example will refer, the metallic body 14 is a parallelepipedon, and the first and second cross-sections of the cavity 20 are rectangular or square.

As an alternative, the metallic body 14 is cylindrical, and the first and second cross-sections of the cavity 20 are circular.

The device 10 further comprises translating means 11 integral with the metallic body 14, which allow the metallic body 14 to be translated along the longitudinal direction D.

The translating means 11 may, for example, be moved manually or by means of a pinion/worm screw motor reducer system or a step motor (neither of which are shown) or other drive systems, whether electric or pneumatic.

The translating means 11 can therefore be controlled from the outside of the metallic body 14 to act, through a suitable mechanical connection, upon the dielectric element 27 in such a way as to translate the dielectric element 27 itself, integrally with the metallic body 14, in the longitudinal direction D.

The following will illustrate a method according to the invention for varying the electric length of a constant-impedance transmission line 12.

With reference to FIG. 2*a*, it is assumed that the transmission line 12 has a section of thickness w and that a first edge 26 thereof is at a first distance z from the inner wall 22 of the metallic body 14 and a second edge 28 thereof is at a second distance y from the inner wall 22 of the metallic body 14: in this case, the first section d of the first portion 21 of the cavity 20 will be d=z+w+y.

If the first distance z equals the second distance y, then the impedance along the transmission line 12 will remain constant.

It must be pointed out that the impedance remains constant during the parallel motion of the metallic body 14 with respect to the transmission line 12.

For example, assuming that the dielectric medium is air, that the thickness w of the transmission line 12 is 1 mm, and that the width of the transmission line 12 is approx. 7.5 mm, in order to obtain an impedance of 50Ω the first distance z and the second distance y will have to be set to 3 mm. The first portion 21 of the cavity 20 will therefore act as an air gap around the transmission line 12 immersed in a first dielectric medium, in particular air.

Similar considerations apply to the second portion 23 of the cavity 20.

With reference to FIG. 2*b*, in order to keep the impedance of the conductive element of the transmission line 12 constant, it is sufficient, in fact, to impose that the distance z' of the first edge 26 of the conductive element of the transmission line 12 from the inner wall 22' of the metallic body 14 and the distance y' of the second edge 28 of the conductive element of the transmission line 12 are equal. For example, assuming that the dielectric material is PTFE having a dielectric constant of 2.1, that the impedance required is still 50 ohm, and that the dimensions of the transmission line 12 are still the same, it will be sufficient to impose that z'=y'=5.65 mm.

By applying simple solid geometry rules, one can obtain that the impedance has a constant value along the entire longitudinal extension of the metallic body 14. More in general, it must be ensured that the transmission line 12 is positioned centrally within the cavity 20, and that its edges 26,28 are equidistant from the inner wall 22,22' of the metallic body 14.

By sliding the metallic body 14 on the transmission line 12, the electric length of the line itself will change, and so will the phase delay of a signal in transit on the transmission line 12.

Figure 3:
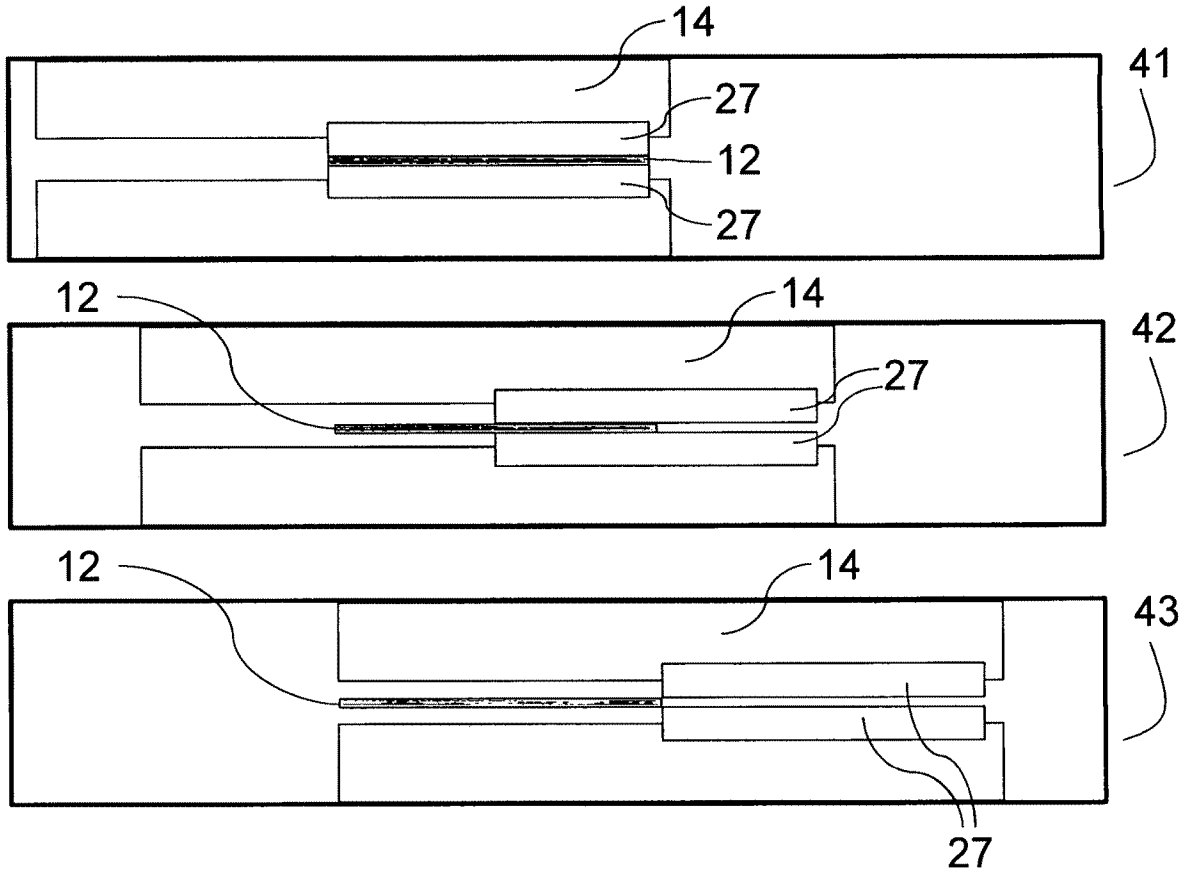
FIG. 3 shows various modes of operation of the switchless combiner according to the present invention.

With reference to FIG. 3, there is shown a diagram that illustrates the effect obtained upon the transmission line 12 by the device 10 according to the invention.

In a first operating position 41, the metallic body 14 is positioned in such a way that the transmission line 12 is completely immersed in the second dielectric medium, in particular PTFE, Position 41 illustrates the case wherein the phase delay of the signal in transit on the transmission line 12 is equal to zero.

In a second operating position 42, a first portion of the element of the transmission line 12 is immersed in the first dielectric medium and a second portion of the transmission line 12 is immersed in the second dielectric medium.

Depending on the phase delay to be obtained, e.g., 90°, the metallic body 14 is simply translated along the transmission line 12 to the desired position. The impedance of the transmission line 12 will still remain constant thanks to the geometric construction of the device 10.

In a third operating position 43, the metallic body 14 is positioned in such a way that the transmission line 12 is completely immersed in the first dielectric medium, in particular air. In this position, the phase delay introduced on the signal may be, for example, 180°.

In the example shown in FIG. 3, it is assumed that the first dielectric medium is air and the second dielectric medium is PTFE.

It is clear that, as the first portion of the transmission line 12, immersed in the second dielectric medium, grows longer, the phase delay of the signal in transit on the transmission line 12 will increase.

It is apparent from the above that implementing a delay line created by means of the device 10 and a constant-impedance transmission line 12 in a switchless combiner can be very useful.

Still with reference to FIG. 2, in fact, in order to implement a line whose electric length must be varied between any two points 34,36 of a circuit 32, e.g., a printed circuit, it will be sufficient to electrically connect the points 34,36 of the circuit 32 by means of a constant-impedance transmission line comprising a transmission line portion 12 covered by the device 10 and two connecting conductive elements 37,38 that connect said points 34,36 to the transmission line portion 12 covered by the device 10.

In particular, if the delay line is one of a switchless combiner, the device 10 according to the invention advantageously allows varying the phase delay of a signal present in a switchless combiner without having to replace the line thereof to comply with the λ/4 requirement. In fact, it will be sufficient to translate the device 10 along the transmission line 12 to change the electric length of the line itself; the variation of the electric length implies a phase delay of the signal running on the transmission line 12, as shown in FIG. 3.

The features of the present invention, as well as the advantages thereof, are apparent from the above description.

A first advantage of the switchless combiner with adjustable phase delay according to the present invention is that it can be manufactured in a simple and economical manner.

A second advantage of the switchless combiner and method according to the present invention is that they can be both easily implemented in a new or an existing circuit.

A further advantage of the switchless combiner and method thereof according to the present invention is that the electric length of the conductor can be adjusted without having to turn off the switchless combiner that comprises said device and/or without having to act upon at least one signal transmitter.

Yet another advantage of the switchless combiner and method thereof according to the present invention is that the phase delay of a signal can be adjusted without having to modify the electric connections of the switchless combiner that comprises said device.

The switchless combiner comprising a device adapted to introduce a phase delay on the electric signals in transit therein and the method thereof described herein by way of example may be subject to many possible variations without departing from the novelty spirit of the inventive idea; it is also clear that in the practical implementation of the invention the illustrated details may have different shapes or be replaced with other technically equivalent elements.

For example, also the first portion 21 of the cavity 20 may be filled with a dielectric material having a cutout corresponding to the slot 24, provided that the dielectric material has a different (e.g., lower) dielectric constant than the second portion 23 of the cavity 20.

For example, dielectric materials other than PTFE may be used, in particular fiberglass-based materials.

For example, the present invention may be used for creating a system of signal transmitters comprising one or more circuits 32 accommodating one or more respective switchless combiners adapted to introduce a delay on one or more signals.

Also, the switchless combiner may comprise one or more devices 10 as described herein, if there are one or more transmission lines 12. In other words, the device 10 may be applied to the transmission line 12 connected to the first transmitter 2 and/or to the transmission line 12' connected to the second transmitter 3. In this latter case, it will be possible to modify the phase delay either on only one of the two transmission lines 12,12' or on both transmission lines 12,12', so as to be able to appropriately modulate the power of the signals being outputted by the switchless combiner.

It can therefore be easily understood that the present invention is not limited to a switchless combiner comprising a device adapted to introduce a phase delay on electric signals in transit therein, and a method thereof, but it may be subject to many modifications, improvements or replacements of equivalent parts and elements without departing from the inventive idea, as clearly specified in the following claims.

The invention claimed is:

1. A switchless combiner comprising:

a circuit having a delay line that includes a constant-impedance transmission line having a fixed length; and a device adapted to vary an electric length of said transmission line, wherein said device comprises a metallic body with an outer wall and an inner wall adapted to define a cavity, said walls being interrupted in a manner such as to define a slot, said cavity and said slot extending along at least a portion of a length of said device, wherein said cavity comprises a first portion having a first cross-section and a second portion having a second cross-section whose area is greater than an area of said first cross-section, said second portion comprising a dielectric element with a cutout corresponding to said slot, said first and second portions extending in the longitudinal direction of said device and said transmission line being positioned, inside said first portion and inside said second portion, in said cutout of said dielectric element, said dielectric element being adapted to occupy the cavity of said second portion, said metallic body being cylindrical, and said first and second cross-sections being circular;

translating means integral with said metallic body for translating said dielectric element on said circuit in the longitudinal direction of said device; and a casing adapted to shield said device from the environment outside said casing.

2. The switchless combiner according to claim 1, wherein said dielectric element is made of a material having a relative dielectric constant greater than 1.

3. The switchless combiner according to claim 2, wherein said material is PTFE or a fiberglass-based material.

4. The switchless combiner according to claim 1, wherein said first portion of the cavity comprises a second dielectric element with a cutout corresponding to said slot, said second dielectric element being adapted to occupy the cavity of said first portion, and said second dielectric element having a different dielectric constant than a dielectric constant of said dielectric element.

5. The switchless combiner according to claim 1, wherein said delay line is positioned in said cavity.

6. The switchless combiner according to claim 5, wherein said transmission line is positioned centrally in said cavity, so that its edges are equidistant from said inner wall.

7. A transmitter comprising a switchless combiner according to claim 1.

8. A system of transmitters of signals comprising a first transmitter and a second transmitter associated with, respectively, a first transmission line and a second transmission line, a switchless combiner according to claim 1, wherein said switchless combiner is connected to said first and second transmitters and is adapted to introduce a delay on one or both signals transmitted on said first and second transmission lines.

9. The system according to claim 8, wherein said switchless combiner is configured to modify the phase delay on one or both of the first transmission line and the second transmission line, so as to suitably modulate a power of said signals being outputted by said switchless combiner.

10. A method for introducing a phase delay on a signal in transit in a switchless combiner comprising a circuit having a delay line that includes a constant-impedance transmission line and a device adapted to vary the electric length of said transmission line, said method comprising the steps of:

positioning said transmission line into a cavity of the device, wherein the device includes a metallic body with an outer wall and an inner wall adapted to define said cavity, said walls being interrupted in a manner such as to define a slot, said cavity and said slot extending along at least a portion of the length of said device, wherein said cavity comprises a first portion having a first cross-section and a second portion having a second cross-section whose area is greater than an area of said first cross-section, said second portion comprising a dielectric element with a cutout corresponding to said slot, said first and second portions extending in the longitudinal direction of said device and said transmission line being positioned, inside said first portion and inside said second portion, in said cutout of said dielectric element, said dielectric element being adapted to occupy the cavity of said second portion, said device including a casing adapted to shield said device from an environment outside said casing, said metallic body being cylindrical, and said first and second cross-sections being circular; and translating said device on said circuit in the direction of its length through means for translating integral with said metallic body, so as to obtain a desired operating frequency.

11. The method according to claim 10, wherein said transmission line is positioned centrally in said cavity, so that its edges are equidistant from said inner wall.

12. A switchless combiner comprising:

a circuit having a delay line that includes a constant-impedance transmission line having a fixed length; and a device adapted to vary an electric length of said transmission line, wherein said device comprises a metallic body with an outer wall and an inner wall adapted to define a cavity, said walls being interrupted in a manner such as to define a slot, said cavity and said slot extending along at least a portion of a length of said device, wherein said cavity comprises a first portion having a first cross-section and a second portion having a second cross-section whose area is greater than an area of said first cross-section, said second portion comprising a dielectric element with a cutout corresponding to said slot, said first and second portions extending in the longitudinal direction of said device and said transmission line being positioned, inside said first portion and inside said second portion, in said cutout of said dielectric element, said dielectric element being adapted to occupy the cavity of said second portion;

translating means integral with said metallic body for translating said dielectric element on said circuit in the longitudinal direction of said device;

wherein said metallic body is cylindrical, and said first and second cross-sections are circular.

* * * * *